US009370782B2

(12) United States Patent
Nishijima et al.

(10) Patent No.: US 9,370,782 B2
(45) Date of Patent: Jun. 21, 2016

(54) METHOD AND APPARATUS FOR SEPARATION OF MIXTURE

(71) Applicants: OSAKA UNIVERSITY, Osaka (JP); UBE INDUSTRIES, LTD., Yamaguchi (JP)

(72) Inventors: Shigehiro Nishijima, Osaka (JP); Fumihito Mishima, Osaka (JP); Koji Kaiso, Yamaguchi (JP); Toshihiro Shimakawa, Yamaguchi (JP)

(73) Assignees: OSAKA UNIVERSITY, Osaka (JP); UBE INDUSTRIES, LTD., Yamaguchi (JP)

( * ) Notice: Subject to any disclaimer, the term of this patent is extended or adjusted under 35 U.S.C. 154(b) by 0 days.

(21) Appl. No.: 14/364,154

(22) PCT Filed: Dec. 11, 2012

(86) PCT No.: PCT/JP2012/082010

§ 371 (c)(1),
(2) Date: Jun. 10, 2014

(87) PCT Pub. No.: WO2013/089080

PCT Pub. Date: Jun. 20, 2013

(65) Prior Publication Data

US 2014/0332449 A1 Nov. 13, 2014

(30) Foreign Application Priority Data

Dec. 12, 2011 (JP) ..... 2011-271472

(51) Int. Cl.
*B03C 1/32* (2006.01)
*B03B 5/66* (2006.01)
(Continued)

(52) U.S. Cl.
CPC . *B03C 1/32* (2013.01); *B03B 5/623* (2013.01); *B03B 5/66* (2013.01); *B03B 13/04* (2013.01);
(Continued)

(58) Field of Classification Search
CPC .... B03C 2201/22; B03C 1/002; B03C 1/025; B03C 1/035; B03C 1/32; B03B 5/66; B03B 5/623
USPC ..... 210/222, 223, 695; 209/223.1, 209/225–227, 232
See application file for complete search history.

(56) References Cited

U.S. PATENT DOCUMENTS 2,612,262 A * 9/1952 Symington et al. ..... 209/5
4,352,730 A * 10/1982 Dijkhuis ..... 209/8
(Continued)

FOREIGN PATENT DOCUMENTS

JP 47-30482 B1 8/1972
JP 57-042354 A 3/1982
(Continued)

OTHER PUBLICATIONS

The International Bureau of WIPO, "English translation of International Preliminary Report on Patentability", Jun. 26, 2014, 6 pp.
(Continued)

*Primary Examiner* — Patrick Cicchino
(74) *Attorney, Agent, or Firm* — Eckert Seamans Cherin & Mellott, LLC; Carol A. Marmo; Grant E. Coffield

(57) ABSTRACT

The present invention provides a method and an apparatus for separating a mixture that are capable of separating a mixture containing a plurality types of particles, using a countercurrent classification technique, even when there is little difference in density and particle diameter depending on the types of particles. In the present invention, a mixture containing first particles and second particles is separated using a separation tube 13 having the inverted-conical or pyramidal shape or a substantially inverted-conical or pyramidal shape. The first particles and the second particles are made of substances having different magnetic susceptibilities. A fluid is caused to flow upward through the separation tube 13, and the flow of the fluid is used to introduce the mixture into the separation tube 13. The first particles and the second particles are held in the separation tube 13 in a mixed state. A gradient magnetic field is applied to a region inside the separation tube 13 using magnetic field generation means 23, in the state where the first particles and the second particles are held in the separation tube 13. The magnetic field gradient of the gradient magnetic field has a vertical component.

12 Claims, 8 Drawing Sheets

(51) Int. Cl.

| | |
|---|---|
| ***B03B 5/62*** | (2006.01) |
| ***B03C 1/033*** | (2006.01) |
| ***B03C 1/28*** | (2006.01) |
| ***B03B 13/04*** | (2006.01) |

(52) U.S. Cl.
CPC ..... *B03C 1/0335* (2013.01); *B03C 1/288* (2013.01); *B03C 2201/18* (2013.01); *B03C 2201/20* (2013.01)

(56) References Cited

U.S. PATENT DOCUMENTS

| | | | | |
|---|---|---|---|---|
| 5,182,253 | A * | 1/1993 | Kishi et al. | 209/2 |
| 6,026,966 | A | 2/2000 | Svoboda | |
| 6,409,925 | B1 * | 6/2002 | Gombinsky et al. | 210/695 |
| 7,022,224 | B2 * | 4/2006 | Stafeev | 209/170 |
| 7,474,184 | B1 * | 1/2009 | Humphries et al. | 335/306 |
| 2002/0020657 | A1 * | 2/2002 | Miller et al. | 209/39 |
| 2002/0153295 | A1 | 10/2002 | Kimura et al. | |
| 2005/0011813 | A1 | 1/2005 | Stafeev | |
| 2010/0140146 | A1 * | 6/2010 | Markov et al. | 209/214 |
| 2013/0143234 | A1 * | 6/2013 | Inaba et al. | 435/7.9 |

FOREIGN PATENT DOCUMENTS

| | | | |
|---|---|---|---|
| JP | 01-304060 | A | 12/1989 |
| JP | 02-031845 | | 2/1990 |
| JP | 02-265661 | A | 10/1990 |
| JP | 04-243559 | | 8/1992 |
| JP | 10-180136 | A | 7/1998 |
| JP | 2002-059026 | A | 2/2002 |
| JP | 2011-041876 | A | 3/2011 |
| JP | 2011-104582 | A | 6/2011 |
| JP | 2011-104583 | | 6/2011 |

OTHER PUBLICATIONS

Japanese Patent Office, "Office Action", Nov. 11, 2014, 3 pp.
Japanese Patent Office, "International Search Report", Mar. 5, 2013, 4 pp.
European Patent Office, Extended European Search Report for European Application No. 12 85 6914.2, mailed Mar. 21, 2016.

* cited by examiner

METHOD AND APPARATUS FOR SEPARATION OF MIXTURE

FIELD OF THE INVENTION

The present invention relates to a method and an apparatus for separating a mixture, by particle type, a mixture containing multiple types of substances, or for separating a specific type of particle from the mixture.

BACKGROUND OF THE INVENTION

Classification commonly refers to an operation for classifying particles having different diameters by their diameters. Countercurrent classification or selection tube classification is a type of classification technique, and is characterized in causing a liquid in which particles are suspended to flow upward (or placing particles into an upward flowing fluid) through a classification tube or a selection tube that is arranged in the vertical direction (see Patent Documents 1 and 2).

FIGS. 8(*a*) to 8(*c*) are diagrams illustrating the principle of countercurrent classification or selection tube classification. Typically, a classification or selection tube 10 for use in the countercurrent classification or selection tube classification has a tapered shape or an inverted-conical shape such that the cross-sectional area of the flow path increases as it goes vertically upward. In the examples shown in FIGS. 8(*a*) to 8(*c*), the classification tube 10 has an inverted-conical shape, and is arranged in the vertical direction. A fluid (or liquid) is caused to flow vertically upward through the classification tube 10. If the velocity (or flow rate) distribution of the fluid is substantially uniform or constant within a horizontal plane (and if the variation in the flow rate in the classification tube 10 over time can be disregarded), the flow rate of the fluid decreases as the diameter of the flow path, or the cross-sectional area, of the classification tube 10 increases, that is, as the fluid rises in the vertical direction.

When a mixture containing first particles having a particle diameter $a_1$ and a density $\rho_1$ (indicated by black circles) and second particles having a particle diameter $a_2$ and a density $\rho_2$ (indicated by white circles) are suspended in a fluid, and the fluid is caused to flow through the classification tube 10 as shown in FIG. 8(*a*), particles contained in the fluid flowing through the classification tube 10 are subjected to the gravitational force and the buoyancy force as well as the fluid resistance force, or so-called drag force, which is proportional to a difference between the flow rate and the particle velocity. A force F, in the vertical direction (i.e., z direction) that acts on each of the particles contained in the fluid flowing through the classification tube 10 is given as follows (where the vertically downward direction is taken as positive):

$$F_z=4/3\pi a_i^3(\rho_i-\rho_0)g-6\pi\eta a_i(v_f-v_{pi})$$

where g is the acceleration of the gravitational force, $a_i$ is the diameter of the particles, $\rho_1$ is the density of the particles, $\rho_0$ is the density of the fluid (or liquid), $\eta$ is the viscosity coefficient of the fluid, $v_f$ is the velocity of the fluid, and $v_{pi}$ is the velocity of the particles. Note that the index i is 1 or 2, and is used for distinguishing between the parameters of the first particles and the parameters of the second particles.

By adjusting the shape of the classification tube 10 or the flow rate of the fluid that flows through the classification tube 10 so that $F_z=0$ is met with respect to both the first particles and the second particles in the classification tube 10 (i.e., so that the drag force, the gravitational force, and the buoyancy force that act on the particles balance out or cancel out in the classification tube 10), the first particles and the second particles float (in a stable manner) at a height where $F_z=0$. If the first particles and the second particles are made of the same substances (if $\rho_1=\rho_2$), the height where $F_z=0$, that is, the height at which the particles float differs according to the diameter of the particles. For example, if $a_1<a_2$, the first particles float in the classification tube 10 at a position that is higher than the height at which the second particles float, as shown in FIG. 8(*b*). The fluid velocity of at the height at which the first particles float is lower than the fluid velocity $v_f$ at the height at which the second particles float. Furthermore, in the case where the mixture is introduced from outside the classification tube 10 into a fluid flowing upward through the classification tube 10 as with the classification apparatuses disclosed in Patent Documents 1 and 2, by adjusting the flow rate of the fluid flowing through the classification tube 10 so that $F_z<0$ is met with respect to the first particles and $F_z>0$ is met with respect to the second particles, it is possible to separate the first particles and the second particles and to collect the respective types of particles from the upper end and the lower end of the classification tube 10.

Accordingly, the particles of the same type (i.e. particles made of the same substance) that have different sizes are separated or classified according to particle diameter using the classification tube 10. As can be seen from the above equation, since the force $F_z$ in the vertical direction that acts on the particles also depends on the density $\rho_i$ of the particles, the height at which the particles in the classification tube 10 float and the direction in which the particles move also depend on the density $\rho_i$ of the particles. Therefore, by suspending, in a fluid, a mixture containing, for example, multiple types of particles that have different densities, that is, multiple types of particles made of different substances, and causing the fluid to flow upward through the classification tube 10, it is possible to separate these particles by type.

PRIOR ART REFERENCES

Patent Documents

Patent Document 1: JP 2-31845A
Patent Document 2: JP 4-243559A

DISCLOSURE OF THE INVENTION

Problems to be Solved by the Invention

However, in a case where a mixture containing multiple types of particles that are made of different substances is separated by type using the classification tube 10, these particles will float at substantially the same height in a mixed state, as shown in FIG. 8(*c*), if the difference in particle density (or specific gravity) due to the difference in substance as well as the difference in particle diameter are small. In this case, it is difficult to separate and further collect the particles by type.

The present invention was made in view of the above-described problem, and it is an object of the present invention to provide a method and an apparatus for separating a mixture that allow, using a countercurrent classification or selection tube classification technique, a mixture containing multiple types of particles to be separated by type, or a specific type of particle to be separated from the mixture, even if differences in particle density and in particle diameter due to a difference in particle type are small.

Means for Solving the Problems

A first mixture separation method of the present invention relates to a mixture separation method for separating, by type, a mixture containing first particles and second particles, which are different in type, or separating a specific type of particle from the mixture, using a separation tube having an inverted-conical shape or a substantially inverted-conical shape, the first particles and the second particles being respectively made of substances having different magnetic susceptibilities, the method comprising: a step of causing a fluid to flow upward through the separation tube; a step of introducing the mixture into the separation tube and holding the first particles and the second particles in the separation tube through which the fluid is flowing; and a step of applying a gradient magnetic field to the first particles and the second particles that are held in the separation tube, wherein a magnetic field gradient of the gradient magnetic field has a vertical component.

Furthermore, the first mixture separation method of the present invention may be such that the first particles are brought together at substantially the same height in the separation tube when the gradient magnetic field is applied, the method further comprises a step of moving the second particles in the separation tube to outside the separation tube by changing the flow of the fluid in the separation tube in a state where the gradient magnetic field is being applied.

A second mixture separation method of the present invention relates to a mixture separation method for separating, by type, a mixture containing first particles and second particles, which are different in type, or separating a specific type of particle from the mixture, using a separation tube that has an inverted-conical shape or a substantially inverted-conical shape, the method comprising: a step of causing a fluid to flow upward through the separation tube to which a gradient magnetic field is applied, introducing the mixture into the separation tube, and holding, in the separation tube through which the fluid is flowing, the first particles and the second particles to which the gradient magnetic field is applied, with distributed regions of the first particles and the second particles separated from each other in the vertical direction, wherein the first particles and the second particles are respectively made of substances having different magnetic susceptibilities, a magnetic field gradient of the gradient magnetic field has a vertical component, and the fluid flows through the separation tube such that the first particles and the second particles are held in the separation tube, even when the gradient magnetic field is not applied to the separation tube.

Furthermore, the second mixture separation method of the present invention may be such that the first particles are brought together at substantially the same height in the separation tube, the method further comprises a step of moving the second particles in the separation tube to outside the separation tube by changing the flow of the fluid in the separation tube.

The first and second mixture separation methods of the present invention may further include a step of causing the fluid in which the mixture is suspended to flow upward through the separation tube.

A mixture separation apparatus of the present invention relates to a mixture separation apparatus for separating a mixture containing first particles and second particles, which are different in type and made of substances having different magnetic susceptibilities, or separating a specific type of particle from the mixture, the apparatus comprising: a separation tube that has an inverted-conical shape or a substantially inverted-conical shape, and through which a fluid is caused to flow upward; flow rate adjusting means for adjusting a flow rate of the fluid that is supplied to the separation tube; and magnetic field generation means for applying a gradient magnetic field whose magnetic field gradient has a vertical component to the separation tube, wherein the flow rate of the fluid that is supplied to the separation tube is adjusted so that the first particles and the second particles are held in the separation tube when the mixture is introduced into the separation tube, and the gradient magnetic field is applied to the first particles and the second particles in a state where the first particles and the second particles are held in the separation tube.

Furthermore, the first mixture separation apparatus of the present invention may be configured such that the first particles are brought together at substantially the same height in the separation tube when the gradient magnetic field is applied, and the second particles in the separation tube move to outside the separation tube by the flow rate adjusting means changing the flow of the fluid in the separation tube in a state where the gradient magnetic field is being applied.

A second mixture separation apparatus of the present invention relates to a mixture separation apparatus for separating a mixture containing first particles and second particles, which are different in type and made of substances having different magnetic susceptibilities, or separating a specific type of particle from the mixture, the apparatus comprising: a separation tube that has an inverted-conical shape or a substantially inverted-conical shape; flow rate adjusting means for adjusting a flow rate of a fluid that is supplied to the separation tube; and magnetic field generation means for applying a gradient magnetic field whose magnetic field gradient has a vertical component to the separation tube, wherein the fluid is caused to flow upward through the separation tube to which the gradient magnetic field is being applied, the mixture is introduced into the separation tube, and the first particles and the second particles to which the gradient magnetic field is being applied are held in the separation tube through which the fluid is flowing, with distributed regions of the first particles and the second particles separated from each other in the vertical direction, and the flow rate of the fluid that is supplied to the separation tube is adjusted such that the first particles and the second particles are held in the separation tube, even when the gradient magnetic field is not applied to the separation tube.

Furthermore, the second mixture separation apparatus of the present invention may be configured such that the first particles are brought together at substantially the same height in the separation tube, and the second particles in the separation tube move to outside the separation tube by the flow rate adjusting means changing the flow of the fluid in the separation tube.

The first and second mixture separation apparatuses of the present invention may be configured such that the fluid in which the mixture is suspended is caused to flow upward through the separation tube.

Furthermore, the mixture separation method and the mixture separation apparatus according to the present invention may be configured such that the fluid is water, and the first particles are made of a paramagnetic substance and the second particles are made of a diamagnetic substance.

Advantageous Effects of the Invention

By applying a gradient magnetic field to a region in the separation tube in a state where the first particles and the second particles in a mixed state are held in the separation tube, the first particles and the second particles are separated from each other based on a difference in magnetic susceptibility between the first particles and the second particles. Therefore, according to the present invention, even if differences in density and particle diameter between the first particles and the second particles are small, it is possible, using a countercurrent classification or selection tube classification technique, to separate these particles by type or to separate either the first particles or the second particles from the mixture. Furthermore, according to the present invention, even if the difference in density between the first particles and the second particles is small, and the particle diameter distributions of the first particles and the second particles overlap each other, it is possible to separate these particles by type or to separate either the first particles or the second particles from the mixture.

Furthermore, according to the present invention, even if the first particles and the second particles can be held in the separation tube in a state of being separated from each other in the vertical direction without a gradient magnetic field being applied, applying a gradient magnetic field to a region in the separation tube makes it possible to distance the region in which the first particles are distributed and the region in which the second particles are distributed from each other in the vertical direction. With this, the separation capability and accuracy are improved, allowing the first particles and the second particles to be more easily collected.

The present invention is characterized in that a gradient magnetic field is applied to the fluid in the separation tube so as to separate the mixture. As a method for separating a mixture using a magnetic field, a magnetic separation method using a magnetic filter is known. In the magnetic separation method using a magnetic filter, typically, a fluid containing particles that are to be separated is caused to flow through the magnetic filter, and thereby the particles are captured by the magnetic filter, but if the particles have a relatively low magnetic susceptibility (if the particles are made of a paramagnetic substance, for example), it is necessary to apply a large magnetic field to the magnetic filter and excite it, in order for the particles to be absorbed by the magnetic filter against the flow of the fluid. In the present invention, since a gradient magnetic field is applied so as to exert a magnetic force on the particles in a state where (almost) no net force acts on the particles to be separated, it is possible to reduce the magnitude of the magnetic field required for separating particles having a low magnetic susceptibility, as compared with the conventional magnetic separation method.

In the conventional magnetic separation method using the magnetic filter, when separating a mixture containing two types of particles by type and collecting the separated particles, one type of particles is captured by the magnetic filter, whereas the other type of particles needs to be collected using collecting means that is provided separately from this magnetic filter. According to the present invention, it is possible to separate the mixture by type by applying a gradient magnetic field to the separation tube, thus allowing efficient separation of the mixture as compared with the conventional magnetic separation method.

DETAILED DESCRIPTION OF THE INVENTION

Figure 1:
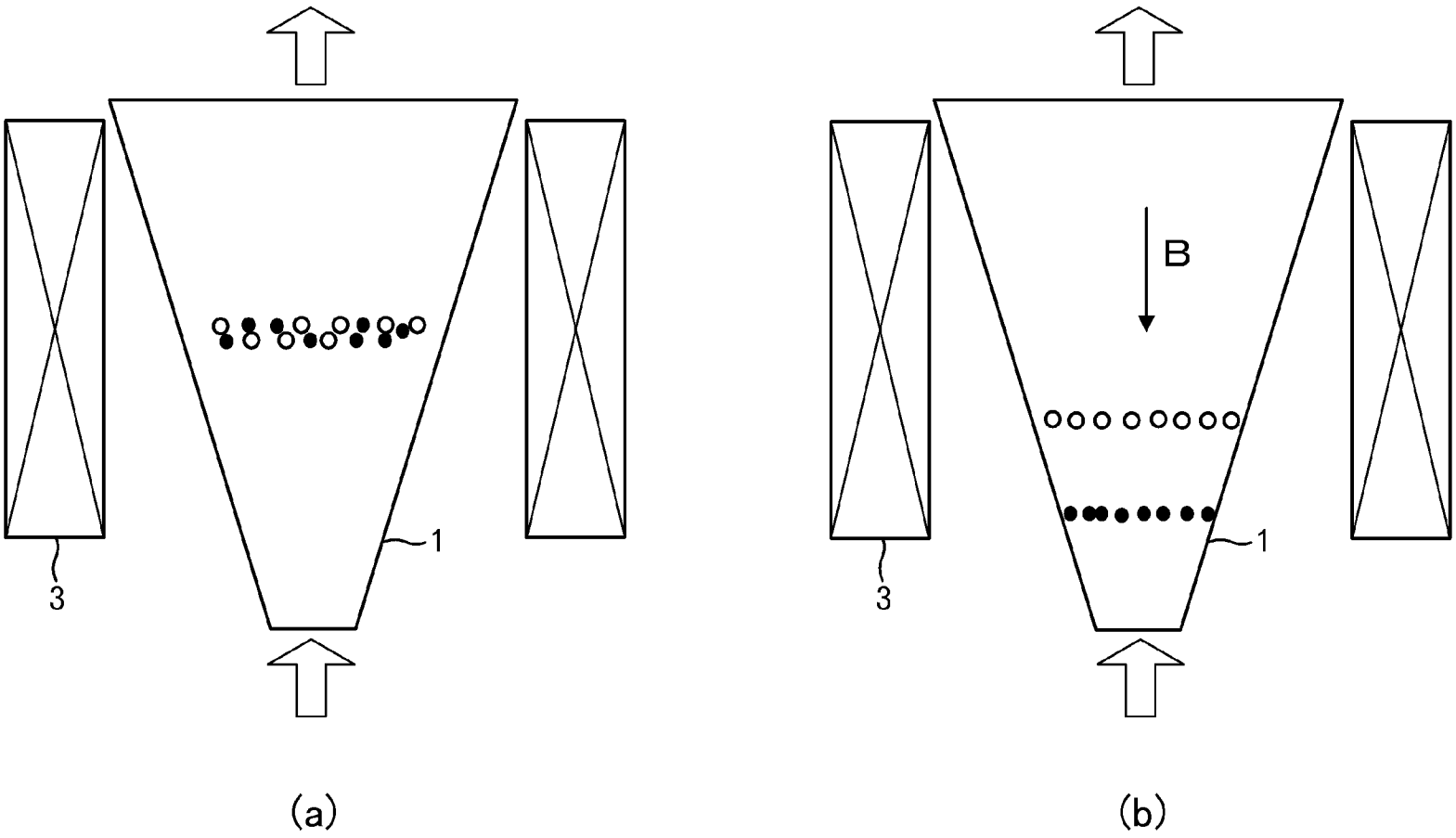
FIGS. 1(*a*) and 1(*b*) are diagrams illustrating a process in which a mixture is separated by particle type according to a mixture separation method of the present invention.

Hereinafter, the present invention will be described. In the present invention, by introducing a mixture containing first particles and second particles into a separation tube using a fluid, and applying a magnetic field having a magnetic field gradient (hereinafter referred to as "gradient magnetic field") to the inside of the separation tube (or applying a gradient magnetic field to a region within the separation tube, and causing a fluid containing the mixture to flow through the separation tube), the first particles and the second particles to which the gradient magnetic field has been applied are separated from each other by type, or either the first particles or the second particles are separated from the mixture. The first particles and the second particles, which are contained in the mixture, are made of substances having different values of magnetic susceptibility (or bulk susceptibility). Either the first particles or the second particles may be made of a ferromagnetic substance, a paramagnetic substance, a diamagnetic substance, or an antiferromagnetic substance, or both the first particles and the second particles may be made of a ferromagnetic substance, a paramagnetic substance, a diamagnetic substance, or an antiferromagnetic substance.

In the present invention, the fluid is caused to flow upward through the separation tube arranged in the vertical direction, and the mixture is introduced into the separation tube using this flow of the fluid, in other words, using the countercurrent that flows against the direction of the gravitational force. Furthermore, in a state where the first particles and the second particles are held in the separation tube based on the principle described with reference to FIGS. 8(*a*) to 8(*c*) (in other words, in a state where $F_z$ that acts on the particles in the separation tube is 0), a gradient magnetic field is applied and these particles are separated by type. Accordingly, the present invention is efficiently applicable to a case where first particles and the second particles have a smaller difference in particle diameter, particle diameter distribution, and/or density than is sufficient for being separated or distinguished from each other only in the separation tube (as shown, for example, in FIG. 8(*c*)). Although the particle diameter (or average particle diameter), the particle diameter distribution, and the density of the first particles and the second particles are not limited as long as the functional effect of the present invention can be achieved, it is preferable that the particle diameter or the average particle diameter of the first particles and the second particles be about several micrometers to several millimeters.

The separation tube of the present invention employs a tube or cylinder that has an inverted-conical shape or a substantially inverted-conical shape, or a tube or cylinder that is arranged vertically, and has a tapered shape or a substantially tapered shape whose diameter increases as it goes upward.

Figure 8:
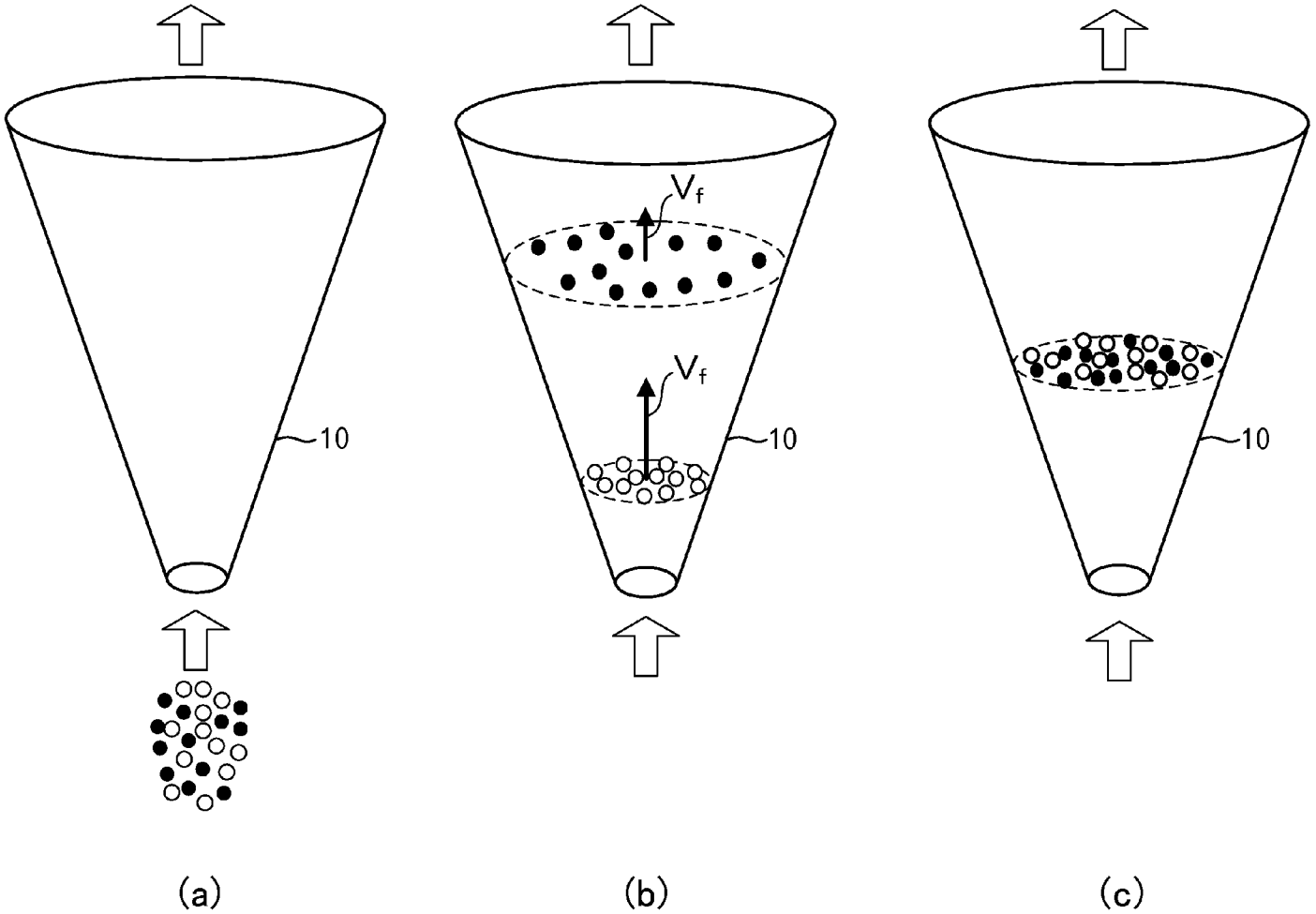
FIGS. 8(*a*) to 8(*c*) are diagrams illustrating a principle of a classification tube.

For example, the separation tube may have an inverted-conical shape, as with the classification tube 10 shown in FIGS. 8(*a*) to 8(*c*). The shape of the separation tube is not limited as long as the functional effect of the present invention can be achieved, and, for example, a separation tube that has a substantially inverted-conical shape or a substantially tapered shape in which, for example, a plurality of tapered sections are coupled with straight tube sections, as disclosed in Patent Document 2, may be employed. The separation tube of the present invention may be a classification tube or selection tube that is used in a conventional countercurrent classification apparatus, that is, a classification tube or selection tube that has an inverted-conical shape, a substantially inverted-conical shape, a tapered shape, or a substantially tapered shape, and has the above-described classification function. Although the cross-sectional shape of the separation tube is preferably circular, it is also possible that the cross-sectional shape of the separation tube is, for example, ellipsoidal or polygonal. The separation tube is preferably made from a nonmagnetic material (for example, a nonmagnetic metal material or a nonmagnetic resin (a nonmagnetic stainless steel, an acrylate resin, or the like)).

In the present invention, a magnetic field having a magnetic field gradient is applied to the separation tube in the state where the first particles and the second particles are held in the separation tube, or before the first particles and the second particles are introduced into the separation tube. The magnetic field gradient of the gradient magnetic field has a vertical component. The force $F_z$, which acts on the first particles or the second particles in the separation tube when such a gradient magnetic field has been applied, is given as follows (where the vertically downward direction is taken as positive):

$$F_z=4/3\pi a_i^3(\rho_i-\rho_0)g-6\pi\eta a_i(v_f-v_{pi})-4/3\pi a_i^3(X_i-X_0)/\mu_0\cdot B\partial B/\partial z$$

where $X_i$ is the magnetic susceptibility (bulk susceptibility) of the first particles or the second particles (i=1 or 2), $X_0$ is the magnetic susceptibility (bulk susceptibility) of the fluid, $\mu_0$ is the magnetic permeability in vacuum, B is the magnetic field (magnetic flux density), and $\partial B/\partial z$ is the magnetic field gradient. The other parameters are the same as those in the foregoing equation.

When no gradient magnetic field is applied, the first particles and the second particles in a mixed state float at a height at which $4/3\pi a_i^3(\rho_i-\rho_0)g-6\pi\eta a_i(v_f-v_{pi})$ is zero, as described, for example, with reference to FIG. 8(*c*), if there is no noticeable differences in the particle diameter $a_1$ and the density $\rho_i$. When a gradient magnetic field is applied, the height at which the first particles or the second particles float varies due to the effect of the term $4/3\pi a_i^3(X_i-X_0)/\mu_0\cdot B\partial B/\partial z$. This term depends on the magnetic susceptibility of the particles. Since the first particles and the second particles are made of substances that have different magnetic susceptibilities, the first particles and second particles that were present in a mixed state float at different heights depending on the magnetic susceptibilities by the application of a gradient magnetic field, and are separated by type. Even if the difference in magnetic susceptibility between the first particles and the second particles is relatively small, by increasing the product obtained from the magnetic field and the magnetic field gradient, it is possible to float the first particles and the second particles at different heights so as to enable them to be separated and respectively collected. The first particles or second particles individually float at substantially the same height in the separation tube. The present invention may be applied in order to improve the separation capability and accuracy, or to further distance a region in which the first particles are distributed and a region in which the second particles are distributed so as to enable easy collection of both types of particles, even in a case where the difference in the particle diameter $a_i$ or the density $\rho_i$ between the first particles and the second particles is sufficient for the first particles and the second particles to be held in a state where the distributed regions thereof are separated from each other in the separation tube.

Although a fluid that is caused to flow through the separation tube is not limited as long as the functional effect of the present invention can be achieved, it is preferable that a fluid be selected taking into consideration the magnetic property and the density of a mixture to be separated. As a fluid for use in the present invention, for example, water or distillated water (which is diamagnetic), or a paramagnetic inorganic salt solution such as a manganese chloride solution or a gadolinium chloride solution (which is paramagnetic) may be used. It is preferable that the magnetic property of the fluid and the magnetic property of at least one type of the first particles and the second particles be different. In the present invention, a gas may also be used as the fluid that is caused to flow through the separation tube.

As magnetic field generation means for generating a gradient magnetic field, for example, a superconductive or normal conductive solenoid electromagnet, which is arranged surrounding the separation tube, or a superconductive bulk magnet or a permanent magnet, which is arranged on the lower side of the separation tube, may be used. The gradient magnetic field is generated such that the magnetic field gradient within the separation tube has a vertical component. Although the direction of the gradient magnetic field is not particularly limited, the gradient magnetic field may be generated, for example, vertically upward or downward. For example, a vertically upward or downward gradient magnetic field whose magnetic field monotonically decreases in the vertical direction may be applied to the inside of the separation tube.

Hereinafter, some cases in which particles contained in a mixture are separated by type using the mixture separation method of the present invention will be described with reference to the drawings.

A case will be considered where the fluid is diamagnetic (for example, the fluid is water), and first particles and second particles that have no noticeable difference in density (the same applies to the following cases) are made of a paramagnetic substance ($X_1>X_2>>X_0$). The fluid in which a mixture containing the first particles and the second particles is suspended flows through a vertically arranged separation tube 1 (having an inverted-conical shape) from the lower end toward the upper end of the separation tube 1. When, under a situation where the first particles (indicated by black circles) and the second particles (indicated by white circles) in a mixed state are floating in the separation tube 1, as shown in FIG. 1(*a*), a gradient magnetic field whose magnetic field gradient has a vertical component (for example, a component in the vertically downward direction) is applied using magnetic field generation means 3, the first particles and the second particles move within the separation tube 1 so as to float at different heights, and are separated by type, as shown in FIG. 1(*b*). The particles move upward and downward depending on whether the product obtained from the magnetic field and the magnetic field gradient (that is, $B\partial B/\partial z$) is positive or negative. The first particles whose magnetic susceptibility is higher than that of the second particles move more significantly than the second particles. Each of the first particles or the second particles floats at substantially the same height within the separation tube 1. The first particles and the second particles that were separated in the separation tube 1 may be collected outside the separation tube 1 using, for example, suction nozzles that are provided on the separation tube 1 at the heights corresponding to the heights at which the first particles and the second particles are floating.

Figure 2:
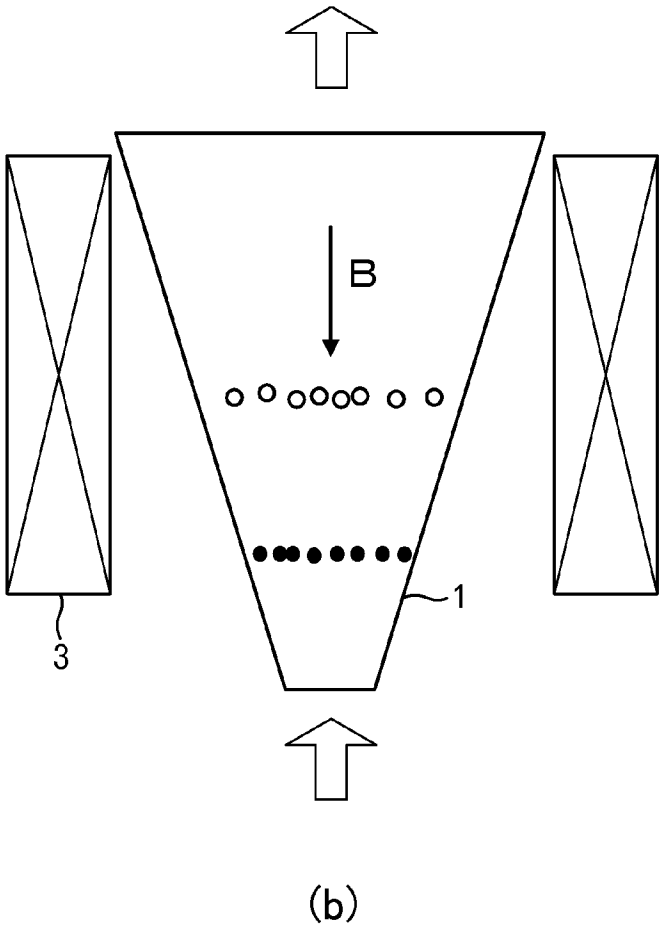
FIGS. 2(*a*) and 2(*b*) are diagrams illustrating a process in which a mixture is separated by particle type according to a mixture separation method of the present invention.
Figure 2:
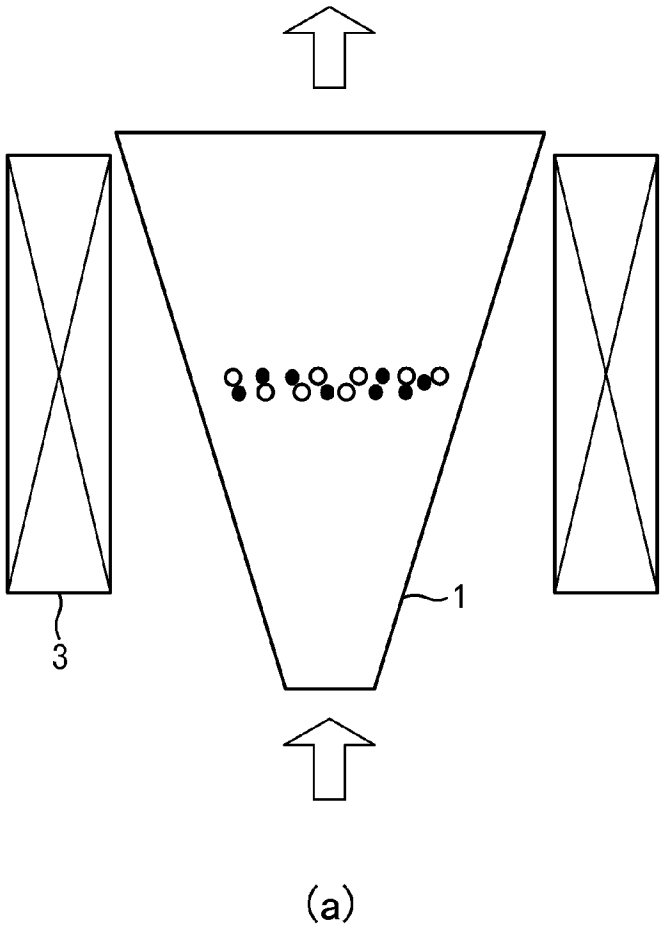

A case will be considered where the fluid is diamagnetic (for example, the fluid is water), and first particles are made of a paramagnetic substance and second particles are made of a diamagnetic substance ($X_1 >> X_2 \approx X_0$). In this case, when, under a situation where the first particles and the second particles in a mixed state are floating in the separation tube 1, as shown in FIG. 2(*a*), a gradient magnetic field whose magnetic field gradient has a vertical component (for example, a component in the vertically downward direction) is applied using the magnetic field generation means 3, the height at which the first particles float varies as shown in FIG. 2(*b*), and thereby the first particles and the second particles are separated by type. The height at which the second particles float does not (really) vary. This is because the fluid and the second particles are both diamagnetic, and the second particles to which the gradient magnetic field was applied are hardly influenced by the term $4/3\pi a_i^3(X_i-X_0)/\mu_0 \cdot B\partial B/\partial z$ of the above-described $F_z$ (the value of $X_2-X_0$ is very small).

Figure 3:
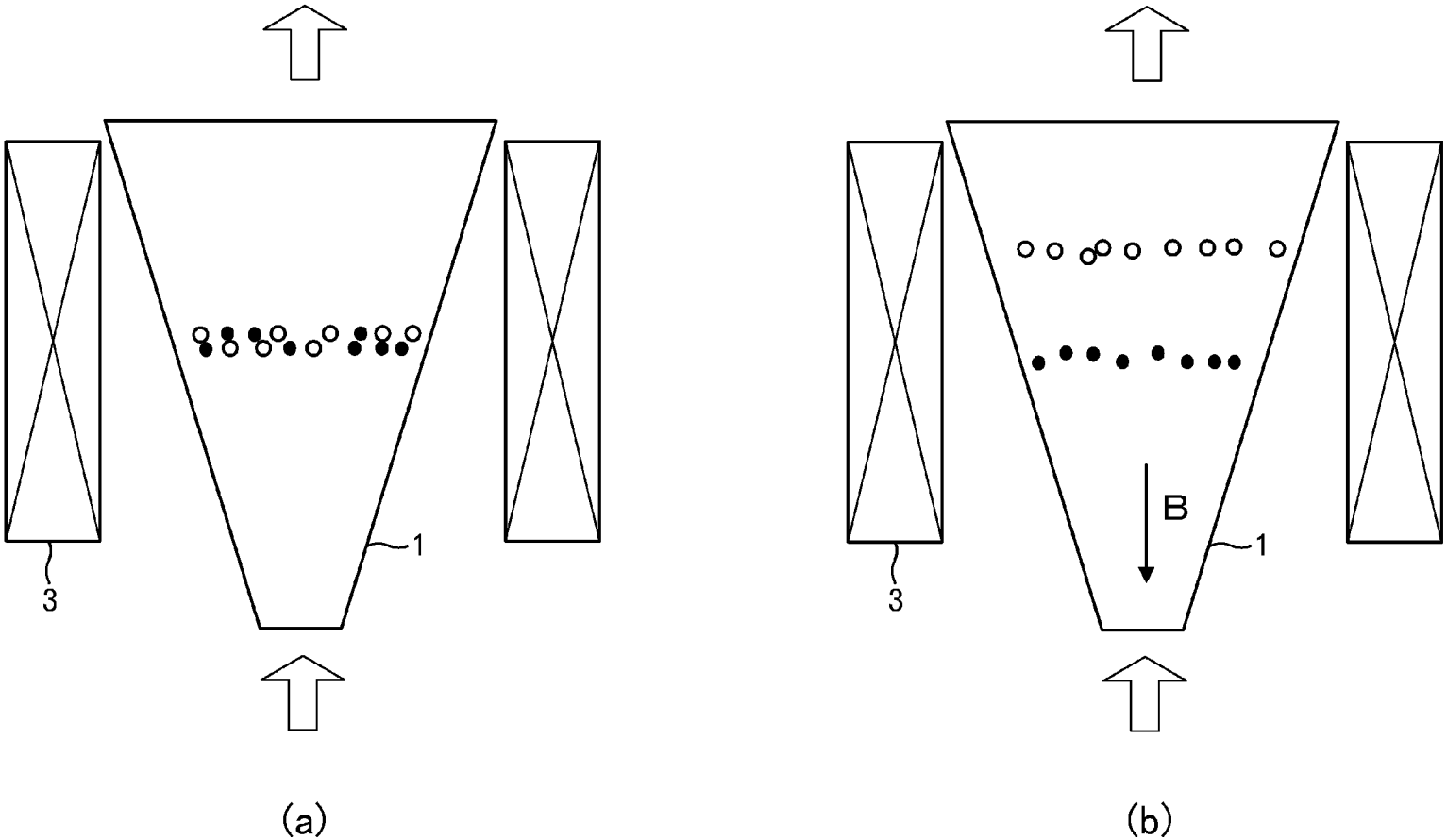
FIGS. 3(*a*) and 3(*b*) are diagrams illustrating a process in which a mixture is separated by particle type according to a mixture separation method of the present invention.

A case will be considered where the fluid is paramagnetic (for example, the fluid is a manganese chloride solution), and first particles are made of a paramagnetic substance, and second particles are made of a diamagnetic substance ($X_1 > X_0 >> X_2$, or $X_0 > X_1 >> X_2$). In this case, when, under the situation in which the first particles and the second particles in a mixed state are floating in the separation tube 1, as shown in FIG. 3(*a*), a gradient magnetic field whose magnetic field gradient has a vertical component (for example, a component in the vertically downward direction) is applied using the magnetic field generation means 3, the height at which the second particles float varies as shown in FIG. 3(*b*), and thereby the first particles and the second particles are separated by type. The height at which the first particles float does not really vary (or the variation in the height at which the first particles float is much smaller than the variation in the height at which the second particles float). This is because the fluid and the first particles are both paramagnetic, and the first particles are hardly influenced by the term $4/3\pi a_i^3(X_i-X_0)/\mu_0 \cdot B\partial B/\partial z$ of the above-described $F_z$ (the value of $X_1-X_0$ is small).

Figure 4:
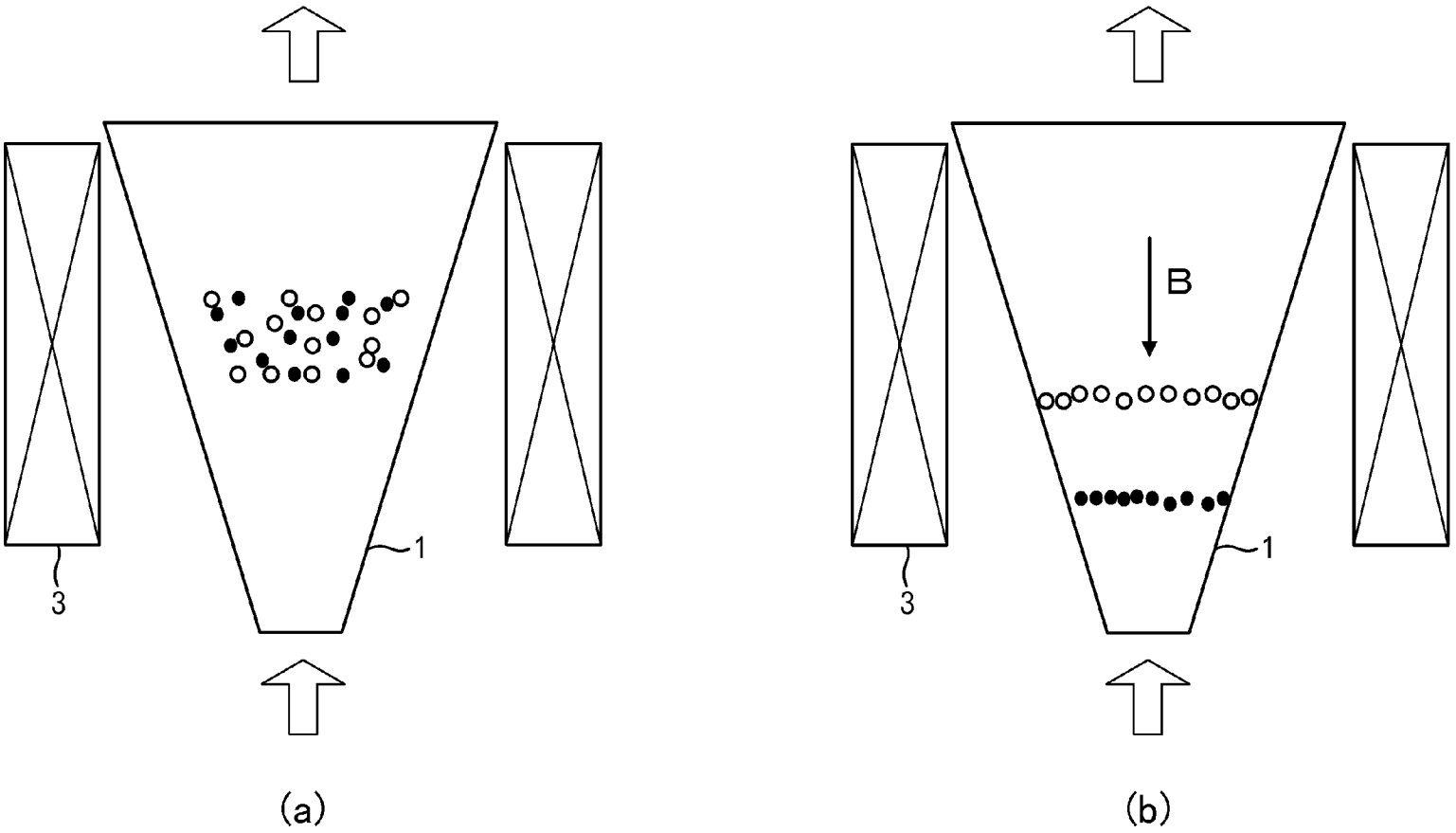
FIGS. 4(*a*) and 4(*b*) are diagrams illustrating a process in which a mixture is separated by particle type according to a mixture separation method of the present invention.

In the descriptions of the cases exemplified in FIGS. 1 to 3, the particle diameter distributions of the first particles and the second particles are not taken into consideration. However, when the particle diameter distributions of the first particles and the second particles are narrow, the particles are separated in the separation tube 1 as described above. The present invention is effective in that these particles can be separated by type even in the case where the particle diameter distribution of the first particles and/or the particle diameter distribution of the second particles are/is wide, and furthermore the particle diameter distributions overlap each other. For example, in a case where the particle diameter distributions of the first particles and the second particles are wide and furthermore overlap each other, the fluid is diamagnetic (for example, the fluid is water), and first particles and second particles are both made of a paramagnetic substance ($X_1 > X_2 >> X_0$), when the fluid that contains the mixture flows through the separation tube 1, the first particles and the second particles are distributed so as to spread out in the vertical direction in the separation tube 1 (such that the distributed regions overlap each other) and are mixed, as shown in FIG. 4(*a*). When, under this situation, a gradient magnetic field whose magnetic field gradient has a vertical component is applied using the magnetic field generation means 3, respective types of the first particles and the second particles gather, that is, so as to float at different heights depending on the magnetic susceptibilities of the particles, as shown in FIG. 4(*b*), and are separated by type. Since the magnetic force generated by the term $4/3\pi a_i^3(X_i-X_0)/\mu_0 \cdot B\partial B/\partial z$ acts on the first particles and the second particles, the distributions of the first particles and the second particles in the vertical direction become narrower.

Figure 5:
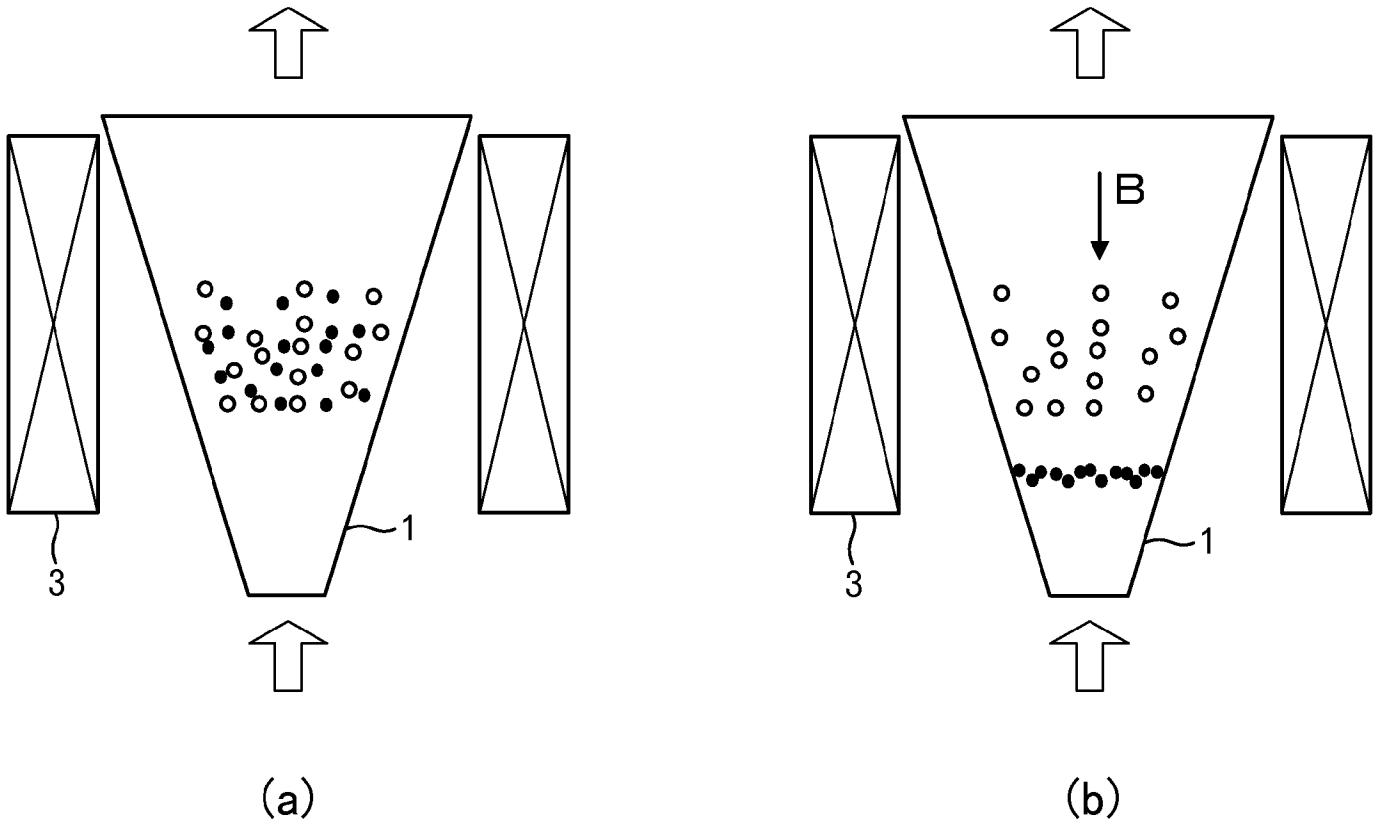
FIGS. 5(*a*) and 5(*b*) are diagrams illustrating a process in which a mixture is separated by particle type according to a mixture separation method of the present invention.

For example, in the case where the particle diameter distributions of the first particles and the second particles are wide and furthermore overlap each other, the fluid is diamagnetic (for example, the fluid is water), and first particles are made of a paramagnetic substance and second particles are made of a diamagnetic substance ($X_1 >> X_2 \approx X_0$), when the fluid that contains the mixture flows through the separation tube 1, the first particles and the second particles are distributed so as to spread out in the vertical direction in the separation tube 1 (such that the distributed regions overlap each other) and are mixed, as shown in FIG. 5(*a*). When, under this situation, a gradient magnetic field is applied using the magnetic field generation means 3, the first particles move and gather so as to float at substantially the same height, as shown in FIG. 5(*b*), and thereby the first particles and the second particles are separated by type. Even with the application of the gradient magnetic field, the distributed region of the second particles does not really vary.

Figure 6:
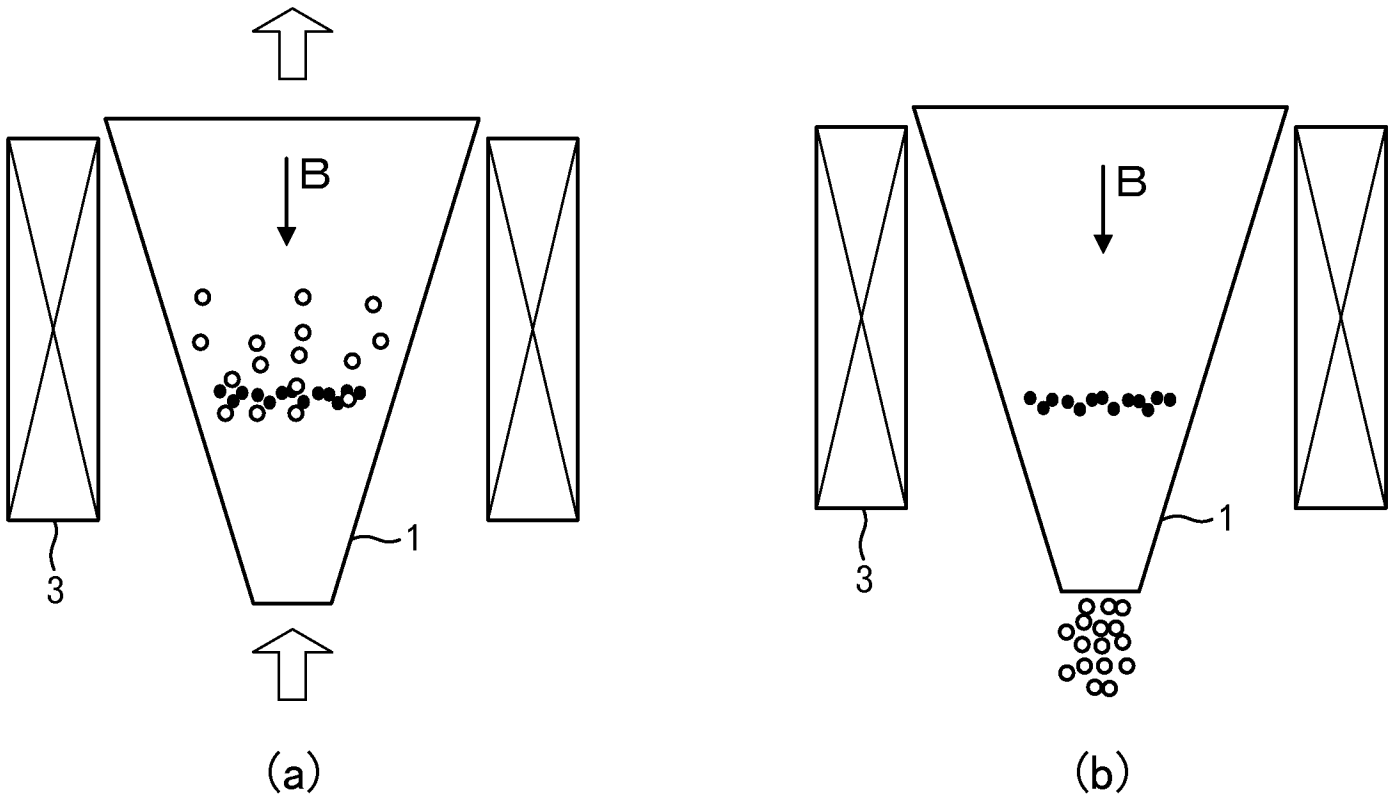
FIGS. 6(*a*) and 6(*b*) are diagrams illustrating a process in which a mixture is separated by particle type according to a mixture separation method of the present invention.

When applying a gradient magnetic field using the magnetic field generation means 3 under the situation shown in FIG. 5(*a*), if the distributed region of the second particles expands due to a turbulent flow or the like of the fluid in the separation tube 1, the first particles may gather and float at substantially the same height within the distributed region of the second particles, as shown in FIG. 6(*a*). In such a case, by controlling the flow of the fluid in the separation tube 1 while applying the gradient magnetic field using the magnetic field generation means 3 (by reducing the flow rate of the fluid that enters the separation tube 1, for example), it is possible to cause only the second particles to precipitate and be discharged out of the separation tube 1, as shown in FIG. 6(*b*). With this, the first particles and the second particles are separated by type. Although the floating position of the first particles varies, the first particles are held in the separation tube 1 due to the effect of the magnetic force of the term $4/3\pi a_i^3(X_i-X_0)/\mu_0 \cdot B\partial B/\partial z$.

The mixture that is to be processed according to the present invention may include, in addition to the first particles and the second particles, one or more other types of particles, which are different from these types of particles. The one or more other types of particles have a magnetic susceptibility that is different from those of the first particles and the second particles. Alternatively, the one or more other types of particles have a density that is different from those of the first particles and the second particles. For example, when, in the case exemplified in FIGS. 1(*a*) and 1(*b*), the mixture includes paramagnetic third particles and the first to third particles are present in a mixed state in the separation tube 1, the third particles float at a height that is different from the heights at which the first and second particles float, by the application of a gradient magnetic field using the magnetic field generation means 3, and the first to third particles are separated by type.

The present invention is applicable not only to the case where a mixture containing first particles and second particles is separated by type, but also the case where a specific type of particle, that is, the first particles or the second particles are separated from the mixture. In the case where, in addition to the first particles and the second particles, one or more other types of particles, which are different from these types of particles, are contained in the mixture, particles of the types that are not to be separated should remain present in a mixed state even when a gradient magnetic field is applied.

Although, in the above-described cases, a gradient magnetic field is applied to the inside of the separation tube 1 in a state where the mixture is introduced into and held in the separation tube 1, it is also possible to cause the fluid to flow through the separation tube 1 in a state where a gradient magnetic field is being applied to the inside of the separation tube 1, and to introduced the mixture into the separation tube 1 using this flow. In this case, as shown as the examples of FIGS. 1(*a*), 2(*a*), 3(*a*), 4(*a*), and 5(*a*), the fluid flows so as to hold the mixture (or the first and second particles) in the separation tube 1 in a state where no gradient magnetic field is applied. That is, the flow rate of the fluid that is supplied to the separation tube 1 to which a gradient magnetic field is being applied is adjusted by flow rate adjusting means such that the first particles and the second particles can be held in the separation tube 1, as shown in the examples of FIGS. 1(*a*), 2(*a*), 3(*a*), 4(*a*), and 5(*a*), even in the state where no gradient magnetic field is applied to the separation tube 1.

In the above-described cases, although the fluid in which the mixture is suspended is introduced into the lower end of the separation tube 1 and flows through the separation tube 1 upward to its upper end, a fluid that does not contain the mixture may be introduced into the lower end of the separation tube 1 and flow through the separation tube 1, and the mixture may be introduced into the separation tube 1 separately from the fluid. For example, the same fluid containing the mixture may be introduced into the separation tube 1 separately via, for example, a conduit line that is connected to the side wall of the separation tube 1. After a certain amount of the mixture is introduced into and held in the separation tube 1, a gradient magnetic field may be applied to the inside of the separation tube 1. Alternatively, the mixture may be introduced into the separation tube 1 while the gradient magnetic field is being applied to the inside of the separation tube 1. In the case where the mixture is introduced into the separation tube 1 through the conduit line connected to the side wall of the separation tube 1 while a gradient magnetic field is being applied to the inside of the separation tube 1, it is preferable that a discharge outlet of the conduit line be provided on the separation tube 1 between the positions at which the first particles and the second particles float.

Figure 7:
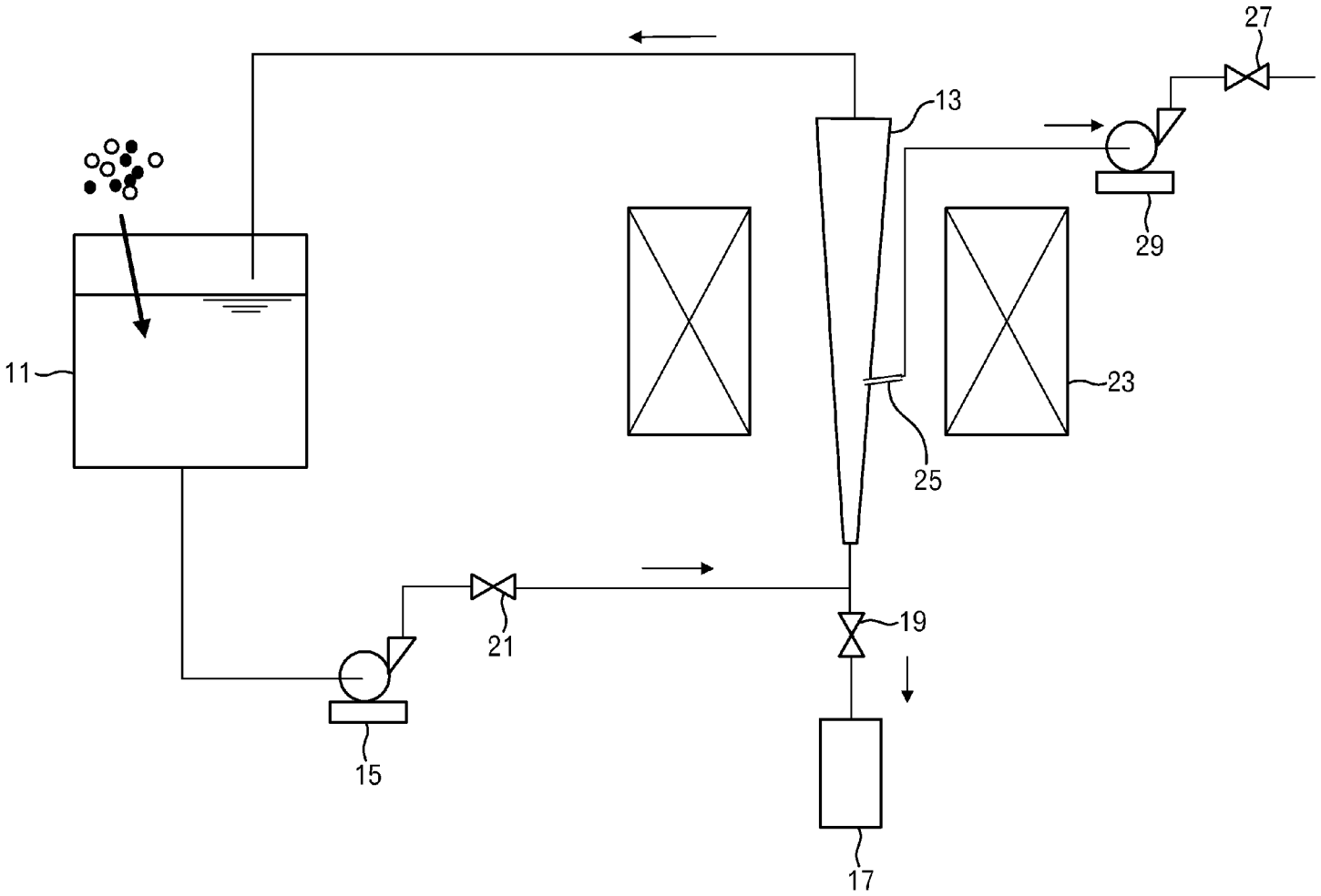
FIG. 7 is a diagram schematically illustrating a mixture separation apparatus according to an embodiment of the present invention.

FIG. 7 schematically illustrates the outline of a mixture separation apparatus according to an embodiment of the present invention. The mixture separation apparatus includes a tank 11 in which a fluid (or liquid) is stored, and a separation tube 13 through which the fluid supplied from the tank 11 flows and that may have an inverted-conical or pyramidal shape or a tapered shape. The separation tube 13, which has an inverted-conical shape, is arranged in the vertical direction. The fluid stored in the tank 11 is supplied by a supply pump 15 to the inlet of the separation tube 13 at the lower end of the separation tube 13. A collection vessel 17 is provided on the lower side of the separation tube 13, and is connected to the lower end of the separation tube 13 via a conduit line on which a first stop valve 19 is arranged. To this conduit line between the separation tube 13 and the first stop valve 19, a conduit line that is connected to the outlet of the supply pump 15 is connected. A flow rate adjusting valve 21 for adjusting the flow rate (volume per unit time) of the fluid that is supplied to the separation tube 13 is arranged on that conduit line. The outlet at the upper end of the separation tube 13 is connected to the tank 11 via a conduit line, and the fluid that has flowed upward through the separation tube 13 is returned to the tank 11, leading to circulation of the fluid between the tank 11 and the separation tube 13. The flow rate adjusting valve 21 serves as the flow rate adjusting means according to the present invention. Furthermore, the supply pump 15 serves as the flow rate adjusting means, and as supply means for supplying a fluid to the separation tube 13.

In a state where the fluid is circulating between the tank 11 and the separation tube 13, a mixture containing first particles (black circles) and second particles (white circles) whose magnetic susceptibilities are different is placed into the fluid of the tank 11. The mixture is put into the tank 11 directly or in a state of being suspended in the fluid. With this, the mixture containing the first particles and the second particles is introduced into the separation tube 13 by the flow of the fluid flowing from the tank 11 to the separation tube 13. By adjusting the flow rate of the fluid that is supplied to the separation tube 13 appropriately using the flow rate adjusting valve 21, the flow rate (or the flow rate distribution) of the fluid in the separation tube 13 is adjusted such that the first particles and the second particles that were supplied to the separation tube 13 are held in the separation tube 13 (i.e., $F_z$ is 0 with respect to the first particles and the second particles). The fluid from which the first particles and the second particles have been removed is returned to the tank 11 from the separation tube 13.

The mixture separation apparatus includes, in a region of the separation tube 13, magnetic field generation means 23 for applying a gradient magnetic field. The magnetic field gradient of the gradient magnetic field includes a vertical component. In the present embodiment, a superconductive solenoid electromagnet is used as the magnetic field generation means 23, and the separation tube 13 is arranged in a bore of the superconductive solenoid electromagnet coaxially with respect to the coil of the superconductive solenoid electromagnet. The separation tube 13 is made from a nonmagnetic material such as glass, acrylic, or a nonmagnetic metal, and by exciting the magnetic field generation means 23, that is, the superconductive solenoid electromagnet, a vertically upward or downward gradient magnetic field whose magnitude varies in the vertical direction is applied to the region within the separation tube 13.

When the first particles and the second particles introduced into the fluid of the tank 11 are held in the separation tube 13 as shown in, for example, FIG. 1(*a*), 2(*a*), 3(*a*), 4(*a*), or 5(*a*), the fluid that does not include the first particles and the second particles is circulating between the tank 11 and the separation tube 13. In this state, the magnetic field generation means 23 is excited and the gradient magnetic field is applied to the inside of the separation tube 13. Accordingly, as shown in, for example, FIG. 1(*b*), 2(*b*), 3(*b*), 4(*b*), or 5(*b*), the first particles and the second particles are separated from each other in the separation tube 13. A suction tube 25 for collecting the first particles is provided on the tank 11, and one end of the suction tube 25 is arranged in the separation tube 13 at the height corresponding to the height at which the first particles float. The other end of the suction tube 25 is connected to a first particle storage tank (not shown) via a second stop valve 27 and a suction pump 29. By the application of a gradient magnetic field, the first particles and the second particles are separated by type in the separation tube 13 as shown in FIG. 1(*b*), 2(*b*), 3(*b*), 4(*b*), or 5(*b*), the second stop valve 27 is opened and the suction pump 29 is driven to collect the first particles that were brought together at substantially the same height in the separation tube 13 via the suction tube 25, the collected first particles being then supplied to the first particle storage tank.

When the first particles in the separation tube 13 have been collected, the second stop valve 27 is closed, the flow rate adjusting valve 21 is adjusted (or the supply pump 15 is stopped) to stop or reduce the flow rate of the fluid supplied to the separation tube 13, and the magnetic field generation means 23 is demagnetized if necessary (for example, as in the case where the second particles are made of a paramagnetic substance). Accordingly, the second particles settle out in the separation tube 13, and are discharged out of the separation tube 13. When the first stop valve 19 is opened, the second particles that were discharged out of the lower end of the separation tube 13 are stored and collected in the collection vessel 17. Note that the second particles may be collected using the suction tube as with the first particles.

For example, when a gradient magnetic field has been applied and the first particles gather and float in the distributed region of the second particles as described with reference to FIG. 6(*a*), the flow rate adjusting valve 21 is operated, while a gradient magnetic field is being applied, to stop or reduce the flow rate of the fluid that is supplied to the separation tube 13. Accordingly, as shown in FIG. 6(*b*), the first particles are held in the separation tube 13, whereas the second particles settle out and are discharged out of the separation tube 13, resulting in separation of the first particles and the second particles by type. When the first stop valve 19 is opened, the second particles that were discharged from the lower end of the separation tube 13 are collected in the collection vessel 17. Then, the first particles are collected using the suction tube 25.

In the mixture separation apparatus of the above-described embodiment, a gradient magnetic field may be applied to the inside of the separation tube 13 in a state where a fluid is circulating between the tank 11 and the separation tube 13. Under this situation, the mixture containing the first particles and the second particles may be put into the tank 11, and may be supplied to the separation tube 13. At that time, the flow rate of the fluid that is supplied to the separation tube 13 is adjusted using the flow rate adjusting valve 21 such that the first particles and the second particles that were supplied to the separation tube 13 are held in the separation tube 13 even when no gradient magnetic field is applied. Instead of putting the mixture into the tank 11 and introducing the mixture using the countercurrent of a fluid flowing upward through the separation tube 13, the mixture may be introduced into the separation tube 13 separately from the countercurrent using a conduit line or the like that is connected to the side wall of the separation tube 13.

EXAMPLES

Hereinafter, an example of a method and an apparatus for separating a mixture according to the present invention will be described.

A mixture separation apparatus was experimentally manufactured that had the same configuration as that of the mixture separation apparatus shown in FIG. 7 except for the suction tube 25, the second stop valve 27, and the suction pump 29. The experimentally manufactured mixture separation apparatus employed an acrylic inverted-conical separation tube 13. The separation tube 13 had the inverted-conical shape, the length thereof being 800 mm, the inner diameter at the lower end being 3.2 mm, and the inner diameter at the upper end being 48 mm. A superconductive solenoid electromagnet, whose bore diameter was 100 mm and whose length was 460 mm, capable of generating a magnetic field of up to 10 T was used as the magnetic field generation means 23. The separation tube 13 was arranged coaxially with respect to the coil of the superconductive solenoid electromagnet such that the center of the coil of the superconductive solenoid electromagnet matched the center of the separation tube 13, that is, a point on the central axis of the separation tube 13 that is 400 mm apart from the lower end thereof. Distillated water, which is diamagnetic, was used as the fluid, and the distillated water was caused to flow through the separation tube 13 with the (volume) flow rate of 2 L per minute.

In the example, a mixture to be processed was prepared by grinding black glass beads (Colored frit G22 (black) manufactured by Satake Glass Co.), which are paramagnetic, and yellow glass beads (Colored frit G34 (yellow) manufactured by Satake Glass Co.), which are diamagnetic, classifying the resultant particles, and mixing particles whose diameters were from 180 μm to 240 μm in amounts of 1 g for each type. The black glass particles had a specific gravity of 3.20, and a bulk susceptibility of $3.17\times10^{-4}$ in the SI unit system. The yellow glass particles had a specific gravity of 3.21 and a bulk susceptibility of $-9.27\times10^{-6}$ in the SI unit system.

Distillated water was circulated between the tank 11 and the separation tube 13 so as to be supplied into the separation tube 13 with a flow rate of 2 L per minute. Then, the (entire) mixture prepared in the above-described manner was introduced into the fluid in the tank 11. The mixture introduced into the fluid was delivered to the separation tube 13 via the flow of the fluid, and the black glass particles and the yellow glass particles in a mixed state were held in the separation tube 13 as shown in FIG. 5(*a*). Furthermore, a gradient magnetic field was applied to a region in the separation tube 13 so that the magnetic field (magnetic flux density) of the coil center was 5.3 T. With this, the black glass particles that were distributed or suspended in a region, whose width in the vertical direction was 100 mm, within ±50 mm from the coil center with respect to the vertical direction gathered and floated at a height that was 60 mm lower than the coil center, as shown in FIG. 5(*b*) (the black glass particles correspond to the first particles). The yellow glass particles remained distributed or suspended in the region within ±50 mm from the coil center with respect to the vertical direction (the yellow glass particles correspond to the second particles).

Subsequently, in a state where the gradient magnetic field was being applied, the flow rate of the fluid flowing into the separation tube 13 was controlled by the flow rate adjusting valve 21 to reduce the flow rate of the fluid in the separation tube 13. The black glass particles were held in the separation tube 13, whereas the yellow glass particles settled out and were discharged out of the lower end of the separation tube 13. With this, the black glass particles and the yellow glass particles that were present in the separation tube 13 in a mixed state were separated by type. The first stop valve 19 was opened, and the discharged yellow glass particles were collected in the collection vessel 17.

Then, the first stop valve 19 was closed, and the collection vessel 17 was exchanged. Then, the superconductive solenoid electromagnet was demagnetized, and the black glass particles in the separation tube 13 settled out and were discharged out of the lower end of the separation tube 13. The first stop valve 19 was opened, and the discharged black glass particles were collected in a newly provided collection vessel 17.

The weight of the yellow glass particles collected in the collection vessel 17 was measured at approximately 1 g, and the weight of the black glass particles collected in the exchanged collection vessel 17 was measured at approximately 1 g. It was thus confirmed that the present invention allows a mixture containing two types of particles which have no difference in particle diameter distribution and density (specific gravity) but a difference in magnetic susceptibility to be separated and collected by particle type.

In the above-described example, by controlling the flow of the fluid in the separation tube 13 to discharge the yellow glass particles from the separation tube 13, the black glass particles and the yellow glass particles in a mixed state are separated by type. It will be readily appreciated that, in a case where the mixture includes, instead of the diamagnetic yellow glass particles, paramagnetic particles whose specific gravity or density and particle diameter distribution are similar to those of the black glass particles but whose magnetic susceptibility is different from that of the black glass particles (for example, such paramagnetic particles can be obtained by selecting/adjusting the colorant contained in the glass), the black glass particles and the paramagnetic particles will be separated by type with application of a gradient magnetic field, as shown in FIGS. 1(*b*) and 4(*b*). It is thus clear from the above-described example that implementing the present invention enables the separation of a mixture, as with the cases exemplified in FIGS. 5(*b*), as well as FIGS. 1(*b*) to 4(*b*), and 6(*b*).

INDUSTRIAL APPLICABILITY

The present invention is applicable to separation and collection of substances in processing for recycling, for example, industrial waste or household garbage. More specifically, an abrasive, which is used for grinding an optical lens or a glass substrate of a liquid crystal display, and glass particles generated by the grinding can be separated from a mixture thereof and respectively collected.

The foregoing description is for illustrating the present invention, and is not intended to limit or restrict the invention described in the claims. Furthermore, the configuration of the constituent elements of the present invention is not limited to the working example, and it is to be understood that various modifications are possible within the technical scope of the claims.

LIST OF REFERENCE NUMERALS

1 Separation tube
3 Magnetic field generation means
11 Tank
13 Separation tube
15 Supply pump
17 Collection vessel
21 Flow rate adjusting valve
23 Magnetic field generation means

The invention claimed is:

1. A mixture separation method for separating, by type, a mixture containing first particles and second particles which are different in type, or separating a specific type of particles from the mixture, using a separation tube having an inverted-conical or pyramidal shape or a substantially inverted-conical or pyramidal shape, the first particles and the second particles being respectively made of substances having different magnetic susceptibilities, the method comprising:

causing a fluid to flow upward through the separation tube;

introducing the mixture into the separation tube and holding the first particles and the second particles in the separation tube through which the fluid is flowing;

applying a gradient magnetic field to the first particles and the second particles that are held in the separation tube; and moving the second particles in the separation tube to outside the separation tube by changing the flow of the fluid in the separation tube in a state where the gradient magnetic field is being applied, wherein a magnetic field gradient of the gradient magnetic field has a vertical component, and wherein the first particles are brought together at substantially the same height in the separation tube when the gradient magnetic field is applied.

2. A mixture separation method for separating, by type, a mixture containing first particles and second particles which are different in type, or separating a specific type of particles from the mixture, using a separation tube that has an inverted-conical or pyramidal shape or a substantially inverted-conical or pyramidal shape, the method comprising:

causing a fluid to flow upward through the separation tube to which a gradient magnetic field is applied;

introducing the mixture into the separation tube;

holding, in the separation tube through which the fluid is flowing, the first particles and the second particles to which the gradient magnetic field is applied, with distributed regions of the first particles and the second particles separated from each other in the vertical direction; and moving the second particles in the separation tube to outside the separation tube by changing the flow of the fluid in the separation tube, wherein the first particles and the second particles are respectively made of substances having different magnetic susceptibilities, a magnetic field gradient of the gradient magnetic field has a vertical component, the fluid flows through the separation tube such that the first particles and the second particles are held in the separation tube, even when the gradient magnetic field is not applied to the separation tube, and the first particles are brought together at substantially the same height in the separation tube.

3. The mixture separation method according to claim 1, further comprising causing the fluid in which the mixture is suspended to flow upward through the separation tube.

4. The mixture separation method according to claim 1, wherein the fluid is water, and the first particles are made of a paramagnetic substance and the second particles are made of a diamagnetic substance.

5. A mixture separation apparatus for separating a mixture containing first particles and second particles which are different in type and made of substances having different magnetic susceptibilities, or separating a specific type of particle from the mixture, the apparatus comprising:

a separation tube that has an inverted-conical or pyramidal shape or a substantially inverted-conical or pyramidal shape, and through which a fluid is caused to flow upward;

flow rate adjusting means for adjusting a flow rate of the fluid that is supplied to the separation tube; and magnetic field generation means for applying a gradient magnetic field whose magnetic field gradient has a vertical component to the separation tube, wherein the flow rate of the fluid that is supplied to the separation tube is adjusted so that the first particles and the second particles are held in the separation tube when the mixture is introduced into the separation tube, the gradient magnetic field is applied to the first particles and the second particles in a state where the first particles and the second particles are held in the separation tube, the first particles are brought together at substantially the same height in the separation tube when the gradient magnetic field is applied, and the second particles in the separation tube move to outside the separation tube by the flow rate adjusting means changing the flow of the fluid in the separation tube in a state where the gradient magnetic field is being applied.

6. A mixture separation apparatus for separating a mixture containing first particles and second particles which are different in type and made of substances having different magnetic susceptibilities, or separating a specific type of particle from the mixture, the apparatus comprising:

a separation tube that has an inverted-conical or pyramidal shape or a substantially inverted-conical or pyramidal shape;

flow rate adjusting means for adjusting a flow rate of a fluid that is supplied to the separation tube; and magnetic field generation means for applying a gradient magnetic field whose magnetic field gradient has a vertical component to the separation tube, wherein the fluid is caused to flow upward through the separation tube to which the gradient magnetic field is being applied, the mixture is introduced into the separation tube, and the first particles and the second particles to which the gradient magnetic field is being applied are held in the separation tube through which the fluid is flowing, with distributed regions of the first particles and the second particles separated from each other in the vertical direction, the flow rate of the fluid that is supplied to the separation tube is adjusted such that the first particles and the second particles are held in the separation tube, even when the gradient magnetic field is not applied to the separation tube, the first particles are brought together at substantially the same height in the separation tube, and the second particles in the separation tube move to outside the separation tube by the flow rate adjusting means changing the flow of the fluid in the separation tube.

7. The mixture separation apparatus according to claim 5, wherein the fluid in which the mixture is suspended is caused to flow upward through the separation tube.

8. The mixture separation apparatus according to claim 5, wherein the fluid is water, and the first particles are made of a paramagnetic substance and the second particles are made of a diamagnetic substance.

9. The mixture separation method according to claim 2, further comprising causing the fluid in which the mixture is suspended to flow upward through the separation tube.

10. The mixture separation method according to claim 2, wherein the fluid is water, and the first particles are made of a paramagnetic substance and the second particles are made of a diamagnetic substance.

11. The mixture separation apparatus according to claim 6, wherein the fluid in which the mixture is suspended is caused to flow upward through the separation tube.

12. The mixture separation apparatus according to claim 6, wherein the fluid is water, and the first particles are made of a paramagnetic substance and the second particles are made of a diamagnetic substance.

* * * * *